US006131904A

United States Patent [19]

Tomczak

[11] Patent Number: 6,131,904

[45] Date of Patent: Oct. 17, 2000

[54] STRIPPING MECHANISM FOR A DELIVERY FLY ASSEMBLY

[75] Inventor: Charles Tomczak, Naperville, Ill.

[73] Assignee: Goss Graphic Systems, Inc., Westmont, Ill.

[21] Appl. No.: 09/144,884

[22] Filed: Sep. 1, 1998

[51] Int. Cl.[7] ..... B65H 29/06

[52] U.S. Cl. ..... 271/315; 271/187; 271/307

[58] Field of Search ..... 271/315, 82, 83, 271/307, 187

[56] References Cited

U.S. PATENT DOCUMENTS

| | | | |
|---|---|---|---|
| 1,134,550 | 4/1915 | Novick . | |
| 1,588,125 | 6/1926 | Meisel . | |
| 1,756,616 | 4/1930 | Wood . | |
| 1,766,084 | 6/1930 | Richter . | |
| 1,905,687 | 4/1933 | Crafts . | |
| 1,949,152 | 2/1934 | Fankboner | 271/80 |
| 1,956,541 | 4/1934 | Spillane | 93/93 |
| 2,026,162 | 12/1935 | De Manna | 271/80 |
| 2,172,364 | 9/1939 | De Manna | 271/80 |
| 2,403,062 | 7/1946 | Edwards | 93/93 |
| 4,205,837 | 6/1980 | von Hein et al. | 271/270 |
| 4,357,126 | 11/1982 | Kidd et al. | 414/46 |
| 4,434,979 | 3/1984 | Köbler et al. | 271/307 |
| 4,465,193 | 8/1984 | Kokubo et al. | 209/534 |
| 4,511,133 | 4/1985 | Kokubo et al. | 271/3.1 |
| 4,513,958 | 4/1985 | Kokubo et al. | 271/187 |
| 4,565,363 | 1/1986 | Faltin | 271/315 |
| 4,600,186 | 7/1986 | von Hein et al. | 271/182 |
| 4,736,941 | 4/1988 | Petersen | 271/277 |
| 4,738,441 | 4/1988 | Leonard | 271/3 |
| 4,861,019 | 8/1989 | Michalik | 271/315 |
| 4,886,264 | 12/1989 | Haensch | 271/229 |
| 4,900,008 | 2/1990 | Fichter et al. | 271/277 |
| 5,040,783 | 8/1991 | Ruehl | 271/300 |
| 5,125,645 | 6/1992 | Eberle | 271/315 |
| 5,249,791 | 10/1993 | Belanger et al. | 271/182 |
| 5,277,413 | 1/1994 | Boss | 271/315 |
| 5,350,167 | 9/1994 | Hansch | 271/82 |
| 5,452,886 | 9/1995 | Cote et al. | 271/187 |
| 5,611,530 | 3/1997 | Maresse et al. | 271/315 |

FOREIGN PATENT DOCUMENTS

| | | | |
|---|---|---|---|
| 0 059 873 A1 | 2/1982 | European Pat. Off. | B65H 29/40 |
| 31 08 681 A1 | 9/1982 | Germany | B41F 13/70 |

*Primary Examiner*—Christopher P. Ellis
*Assistant Examiner*—Mark A. Deuble
*Attorney, Agent, or Firm*—Marshall, O'Toole, Gerstein, Murray & Borun

[57] ABSTRACT

A fly stripping mechanism for stripping sheet-like objects such as printed material from a rotating fly assembly having a plurality of fly pockets is disclosed. A cam adjacent the fly assembly remains stationary as the fly assembly rotates. A lever is disposed adjacent each fly pocket and is also pivotally mounted to the fly assembly. A cam follower is connected to each lever. As the fly assembly rotates, the cam follower follows the contour of the cam. The contour of the cam slows the rotation of the cam followers relative to the rotational speed of the fly assembly. The slowed rotation of the cam followers in turn causes an end portion of the lever to move from a position adjacent a rearward portion of the fly pocket toward a forward portion of the fly pocket, thereby ejecting printed material from the fly pocket. A method of ejecting sheet-like objects such as printed material from a fly pocket by moving a portion of a lever from a position adjacent a rearward portion of the fly pocket toward a forward portion of the fly pocket is also disclosed.

12 Claims, 4 Drawing Sheets

STRIPPING MECHANISM FOR A DELIVERY FLY ASSEMBLY

FIELD OF THE INVENTION

The present invention relates generally to delivery fly assemblies and more particularly to fly assembly stripping apparatus.

BACKGROUND OF THE INVENTION

Delivery fly assemblies are used to move objects, generally comprising sheet-like material, from a first location to a second location. Often, a delivery fly assembly is associated with printing apparatus and is used to move printed material from a first location adjacent a folding cylinder to a second location on a conveyor.

A delivery fly assembly typically has a plurality of flywings defining fly pockets therebetween, each fly pocket being used to deliver a printed product from the first location to the second location. Delivery is accomplished by rotation of the fly assembly, each fly pocket receiving printed material from the first location and rotating with the fly assembly to the second location where the printed material is dropped off. Sometimes it is desired to change the number of fly pockets on the fly assembly, an increasing number generally resulting in decreased space between printed products deposited on the conveyor. Six, seven or eight fly pockets, for example, are common in the printing industry.

The printed material must somehow be removed from the fly pockets during rotation of the fly assembly in order to be deposited at the second location. A conventional way to remove printed material from the pockets is to have a stationary stop such as a shoe located in the path of the rotating printed material. When the printed material contacts the stop, the printed material can no longer rotate with the fly pocket and is ejected from the pocket while the pocket continues to rotate. A disadvantage of the stationary stop is that removal is abrupt rather than gradual and, consequently, the stop may dent or otherwise deform the printed material.

Another conventional way to remove printed material from the pockets comprises a rotating wheel with teeth. The wheel is rotated slightly slower than the rotation of the fly assembly. The rotational axis of the wheel is typically parallel to the axis of the fly assembly but is offset so that those two axes are not coaxial. As the fly assembly rotates, printed material contacts a tooth of the rotating wheel and is ejected from the fly pocket because the wheel rotates more slowly than the fly assembly. A disadvantage of this stripping mechanism is that it requires a separate drive for the rotating wheel. Also, the relatively complicated timing required for proper operation is very difficult to adjust in the event that an operator desires to change the rate of delivery or to change the relative positions of the first and second locations or to change the number of pockets. In some instances, gears would have to be replaced or a different wheel would be necessary to achieve proper timing.

In another conventional design, the stripper comprises a belt that is driven at a speed that is slightly slower than the rotation of the fly assembly. The belt has teeth that engage and eject the printed material. As with the rotating wheel, an additional drive is necessary and any changes in the operating speed or the number of fly pockets may require significant readjustments in the system including, possibly, switching to a belt on which the spacing of the teeth is different.

SUMMARY OF THE INVENTION

The aforementioned disadvantages of the prior art are overcome with a device and method in accordance with the present invention. In particular, a fly stripping apparatus in accordance with the present invention strips sheet-like objects such as printed material from a plurality of fly pockets of a rotating fly assembly, each fly pocket having a rear portion and a forward portion. The fly stripping apparatus comprises a movable member disposed adjacent each fly pocket. During rotation of the fly assembly, each member moves from a position adjacent the rear portion of its respective fly pocket toward the forward portion of the respective fly pocket to eject the printed material from the fly pocket. The fly stripping apparatus may include a cam for moving each member. The fly stripping apparatus may also include a lever attached to each member and having a cam follower.

Another embodiment of the present invention is a fly stripping apparatus comprising a cam positioned adjacent a fly assembly, and a plurality of levers having a first end portion and a second end portion. The first end portion of each lever is located adjacent a respective fly pocket and the second end portion of each lever is pivotally attached to the fly assembly. A cam follower is attached to each lever for following the cam during rotation of the fly assembly. During rotation of the fly assembly, the first end portion of each lever moves from a first position to a second position. The first position is a position adjacent the rear portion of a respective fly pocket to permit the fly pocket to receive the printed material. The second position is a position between the first position and the forward portion of the respective fly pocket to eject the printed material from the fly pocket.

The fly stripping apparatus may include a plurality of springs each having a first end attached to one of the levers for returning the respective lever to the first position from the second position. The cam may be stationary with respect to the fly assembly and may include an arcuate portion, each lever moving from the first position to the second position while its respective follower follows the arcuate portion of the cam. The cam may also have a return portion, each lever moving from the second position to the first position while its respective follower follows the return portion of the cam.

A further aspect of the present invention is a method of stripping objects such as printed material from fly pockets of a rotating fly assembly. The method comprises the steps of (a) providing an ejector having an operative portion adjacent each pocket; (b) moving the operative portion of the ejector, during rotation of the fly assembly, from a position adjacent the rear portion of its respective fly pocket toward the forward portion of the respective fly pocket; and (c) thereby causing the operative portion of the ejector to cause the printed material to be ejected from the fly pocket. The method may also include the steps of providing a stationary cam positioned adjacent the fly assembly, forming the ejector as a lever having an end portion as the operative portion, providing a cam follower on each lever, and rotating the cam followers around the stationary cam to move the end portion of the lever relative to its respective fly pocket.

DETAILED DESCRIPTION OF THE PREFERRED EMBODIMENT

Figure 1:
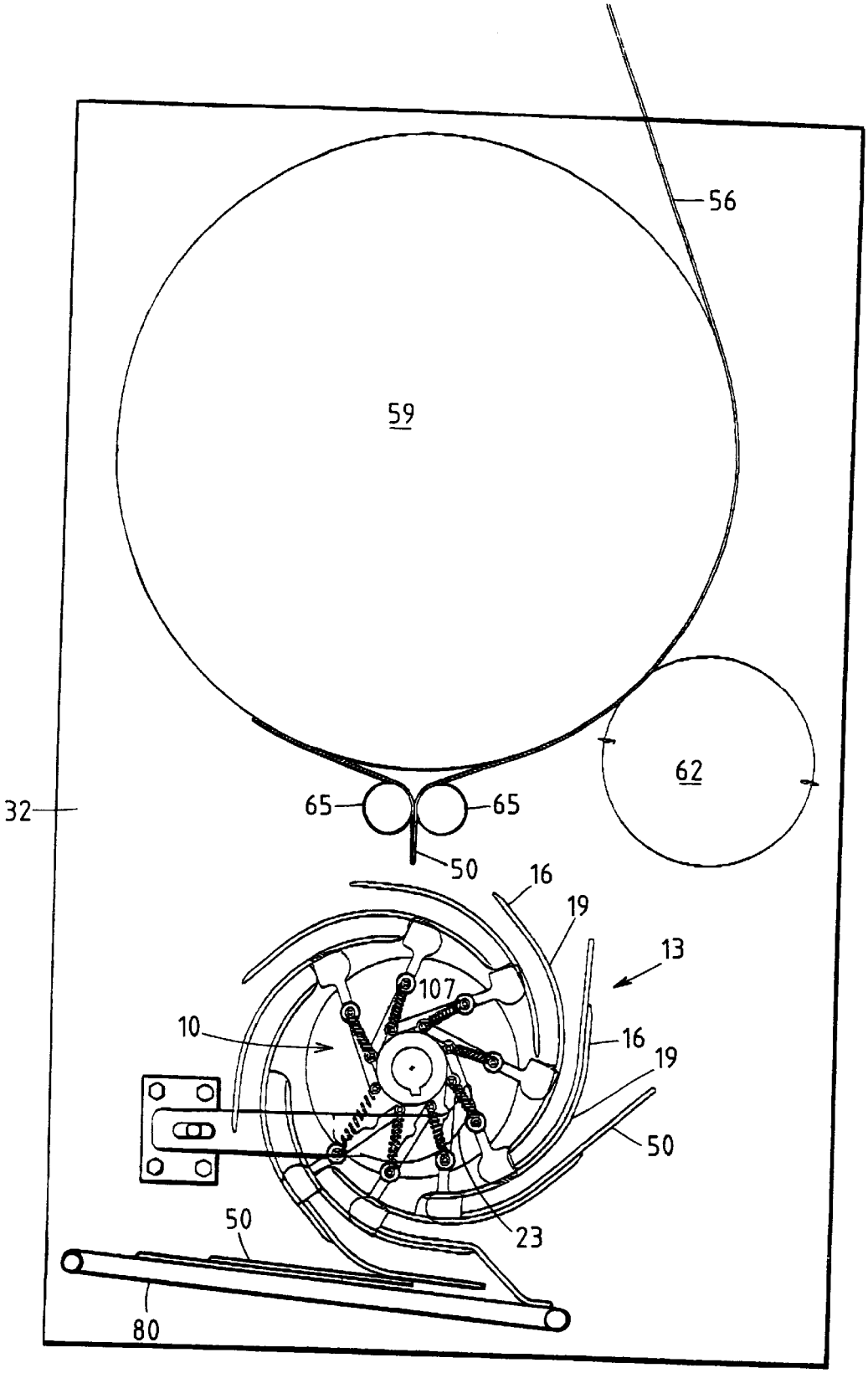
FIG. 1 is a side elevational view of an embodiment of the present invention shown adjacent a folding cylinder and a conveyor.
Figure 2:
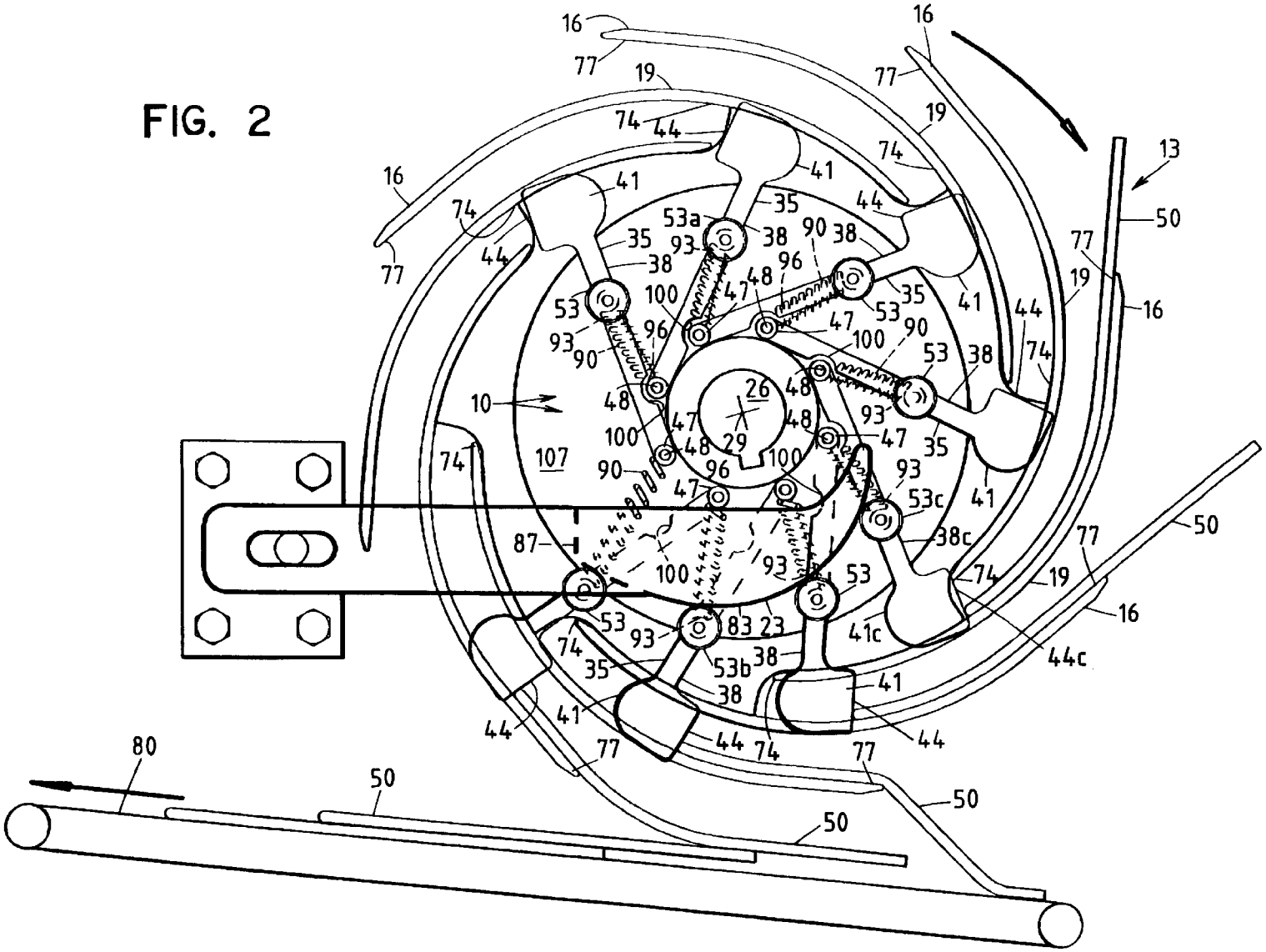
FIG. 2 is an enlarged, side elevational view of the embodiment of the present invention shown in FIG. 1.

As seen in FIGS. 1 and 2, the fly stripping mechanism of the present invention, generally designated 10, operates on a rotating fly assembly 13 having a plurality of flywings 16 which define fly pockets 19 therebetween. Although described below in connection with printing apparatus, the fly stripping mechanism 10 may be associated with other types of apparatus. A cam 23 of the fly stripping mechanism 10 remains stationary as a drive shaft 26 rotates the fly assembly 13 around a rotational axis 29. The cam 23 may be connected to the ground, to a frame 32 (FIG. 4) or to any other object that does not rotate with the fly assembly 13.

A plurality of movable members or ejectors 35 which may take the form of levers 38 are provided and the levers 38 each have an operative portion which may take the form of a first end portion 41 disposed adjacent one of the fly pockets 19. The first end portions 41 may each comprise a piston-shaped member 44. A second end portion 47 of each lever 38 is pivotally mounted to the fly assembly 13. The second end portions 47 each receive a respective post 48 that is attached to the fly assembly 13. A respective cam follower 53 is fixed to each lever 38 between the first and second end portions 41,47.

In operation, and as shown in FIG. 1, printed material 50 from a source which may comprise a web 56 that passes around a folding cylinder 59 is loaded into the fly pockets 19. When the web 56 is the source, it may be cut by a cutting cylinder 62 to form the printed material 50 which passes through nipping rollers 65 and is then deposited in one of the fly pockets 19. The fly stripping mechanism 10 is suitable for other printing devices in which printed material is deposited into the fly pockets 19, the cutting and folding assembly of FIG. 1 being merely an example. Also, the fly stripping mechanism 10 may be used for ejecting objects other than printed material from the fly pockets 19.

As the fly assembly 13 rotates, the cam followers 53 rotate around the rotational axis 29 of the fly assembly 13. It should be noted that the levers 38 and the fly assembly 13 rotate in the same direction, which is clockwise in FIG. 2. The positions of the cam followers 53 can be likened to the hour hand of a clock for purposes of illustration.

In this connection, and by way of example, in FIG. 2, the topmost cam follower 53*a* is at about the 12:00 position, the bottom most cam follower 53*b* is at about the 6:00 position, and rightmost cam follower 53*c* that is contacting the cam 23 is at about the 4:00 position with respect to the rotational axis 29 of the fly assembly 13. Operation is discussed below for only a single lever (lever 38*c*), piston (piston 44*c*), and cam follower (cam follower 53*c*) although eight of each of those features are shown in FIG. 2.

The contour of the cam 23 in the 4:00 to 8:00 positions of the rotational path of the cam follower 53 slows the rotation of the cam follower 53*c* relative to the rotational speed of the fly assembly 13. As the contour of the cam 23 slows the rotation of the follower 53*c*, the lever 38*c* moves from a first position to a second position and, correspondingly, the piston 44*c* connected to the lever 38*c* is moved relative to the corresponding fly pocket 19 from a position adjacent a rear 74 of the fly pocket 19 toward a position between the rear 74 and a forward end 77 of the fly pocket 19. The piston 44*c* movement gradually ejects the printed material 50 that was disposed in that fly pocket 19. The printed material 50 then lands upon a conveyer belt 80 or other device for further processing.

Although the apparatus 10 in the drawings comprises the piston 44*c* for ejecting printed material 50 from the fly pocket 19, it will be understood that a first end portion 41*c* that is not in the shape of the piston 44*c* may be used instead for ejecting printed material. The piston 44*c* is merely one suitable shape for the first end portion 41*c* of the lever 38*c* for pushing printed material 50 out of the fly pocket 19. In embodiments having a first end portion such as 41*c* in the shape of the piston 44*c*, the piston 44*c* may be integral with the lever 38*c* or may be attached to the lever 38*c* by any conventional means.

The cam 23 has a contour which may include an arcuate portion 83 and a return portion 87, as shown in FIG. 2. Thus, the cam path that the cam followers 53 follow is not concentric with the rotational axis 29 of the fly assembly 13. The levers 38 move from the first position to the second position while the respective followers 53 follow the arcuate portion 83 of the cam 23. It is the portion of the cam 23 from approximately the 4:00 position to approximately the 8:00 position of the rotational path of the cam followers 53 (i.e., the arcuate portion 83) which causes the cam followers 53 to deviate from a path concentric with the rotational axis 29 of the fly assembly 13. The deviation provides the decreased rotational speed of the cam followers 53 which in turn causes ejection of the printed materials 50 from the fly pockets 19.

The return portion 87 of the cam 23 is located at approximately the 8:00 position of the rotational path of the cam followers 53. The levers 38 move from the second position to the first position while the respective followers 53 follow the return portion 87 of the cam 23. Thus, soon after the piston 44 has ejected printed material 50, the corresponding cam follower 53 is located at the return portion 87 of the cam 23 which is a portion of the cam 23 in which the cam 23 contour extends inwardly. The cam follower 53 thus moves inwardly, allowing a return spring 90 attached to the lever 38 to pull the lever 38, thereby moving the piston 44 back to the first position (i.e., a position adjacent the rear portion 74 of the fly pocket 19). In this fashion the piston 44 is reset for ejecting another printed product 50 from the fly pocket 19.

Although the return portion 87 is shown in the drawings as a substantially vertical straight portion, the return portion 87 need not be substantially vertical or straight but merely needs to be a contour portion which slopes inwardly (i.e., extends from the arcuate portion 83 closer to the rotational axis 29 of the fly assembly 13). Further, the return portion 87, although shown at the 8:00 position, may be positioned at other locations depending upon specific applications. The slope and position of the return portion 87 are factors in determining the speed of the resetting of the piston 44.

Changing the cam profile by changing its contour geometry or position relative to the fly assembly rotational axis 29 will generate different motions for the levers 38. For example, the radius of curvature of the arcuate portion 83 of the cam 23 may be smaller than for the cam 23 shown in FIGS. 1–3, which would increase the ejection speed movement of lever 38 during the ejection cycle. Alternatively, the radius of curvature of the arcuate portion 83 of the cam 23 may be larger than for the cam 23 shown in FIGS. 1–3, which would decrease the ejection speed movement of lever 38 during the ejection cycle.

A first end 93 of the return spring 90 is attached to a portion of the lever 38 located between the first and second end portions 41,47 of the lever 38. Suitable springs 90 include coil springs. Return mechanisms other than springs are also suitable such as a pneumatic return device (not shown). The first end 93 of the return spring 90 is attached to the same lever 38 which that spring 90 causes to return.

A second end 96 of the return spring 90 is attached to a part of the fly assembly 13 such as the post 48 in the second end portion 47 of an adjacent lever 38. The second end 96 of the return spring 90 is closer to the rotational axis 29 of the fly assembly 13 than is the first end 93 of the return spring 90. Also, the distance of the second end 96 of the return spring 90 from the rotational axis 29 of the fly assembly 13 remains substantially the same during the rotation of the fly assembly 13. Thus, when the return spring 90 contracts to return the lever 38 to the first position from the second position, the first end 93 of the return spring 90 moves toward the second end 96 of the return spring 90.

The levers 38 may each comprise a notch 100 for receiving the second end portion 47 of an adjacent lever 38. The notch 100 thus permits the levers 38, while the levers 38 are in the first position, to be more compactly configured.

Figure 3:
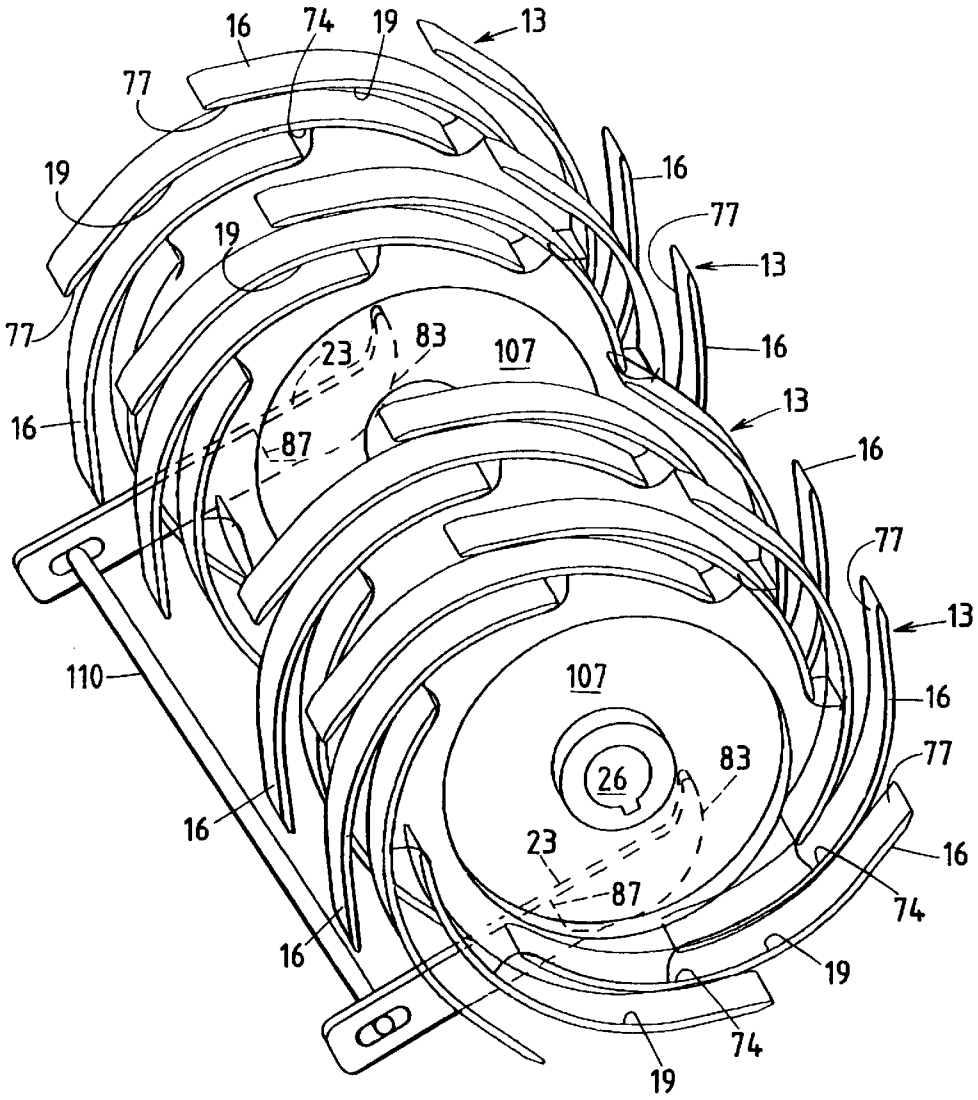
FIG. 3 is an isometric view of the embodiment of FIG. 1 with some features omitted for clarity.
Figure 4:
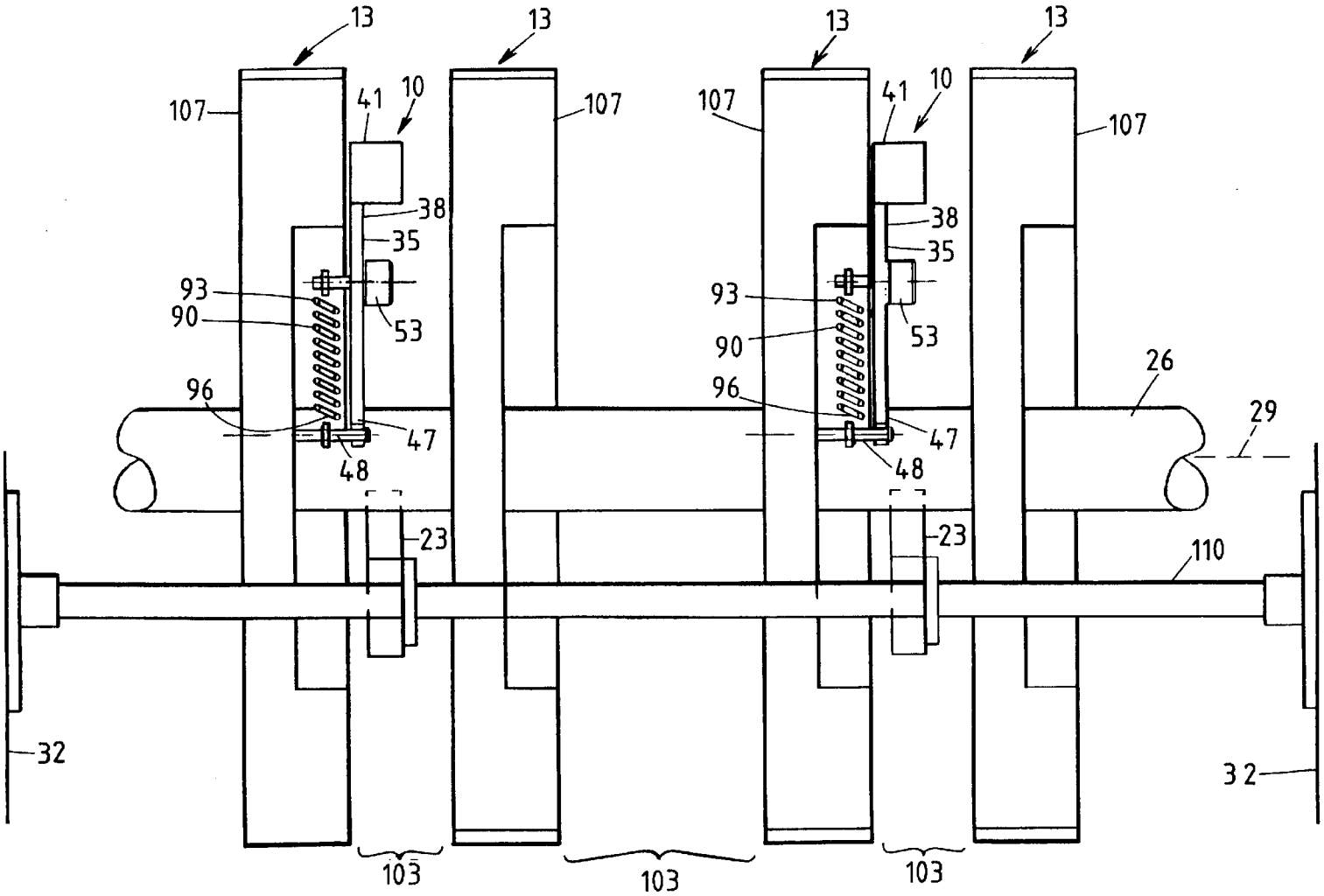
FIG. 4 is a schematic, side elevational view of the embodiment of FIG. 1 with some features omitted for clarity.

As will be appreciated from FIGS. 3 and 4, a plurality of the stripping mechanisms 10 may be employed to strip printed material 50 from the fly pockets 19. Much of the fly stripping mechanisms 10 apart from the cam 23 is omitted from FIG. 3 for clarity. Also, only a single spring 90, cam follower 53, lever 38, and piston 44 are shown for each fly stripping mechanism 10 depicted in FIG. 4. In the embodiment of FIGS. 3 and 4, two of the stripping mechanisms 10 are employed and four fly assemblies 13 are employed. Thus, two of the fly assemblies 13 do not have stripping mechanisms 10 associated with them. One of those two fly assemblies 13 is positioned between the two fly assemblies 13 having the stripping mechanisms 10.

The printed material 50 spans approximately the combined width of the four fly assemblies 13 and therefore extends over spaces 103 between the fly assemblies 13. This allows the printed material 50 to be in the path of the pistons 44 as the pistons 44 move from the first position to the second position. The configuration of FIGS. 3 and 4 permits stripping to be performed with minimal bending or misshaping of the printed material 50, however, other configurations may be suitable.

It should be noted that in the configuration of FIGS. 3 and 4, only two of the fly assemblies 13 have the stripping mechanism 10 adjacent thereto. The other two fly assemblies 13 do not have a stripping mechanism associated with them (but they do provide support for the printed material 50 prior to ejection). Thus, although the stripping mechanisms 10 generally provide means for stripping each pocket 19 of a particular fly assembly 13, not every fly assembly 13 has a stripping mechanism 10 adjacent thereto. Still, because a single piece of the printed material 50 may extend across all four fly assemblies 13 of FIGS. 3 and 4, the two fly stripping mechanisms 10 of that embodiment in fact strip all four fly assemblies 13. Other numbers of and configurations of stripping mechanisms 10 and fly assemblies 13 may be employed, the embodiment of FIGS. 3 and 4 being merely an example.

A hub 107 is connected to the drive shaft 26 and is also connected to the flywings 16 (not shown in FIG. 4). Also shown in FIG. 4 is a support member 110 bracketed to the cam 23 and attached to the frame 32.

An alternative to the embodiment of FIGS. 3 and 4 in which the stripping mechanisms 10 are each positioned adjacent one of the fly assemblies 13 is an embodiment (not shown) in which the pistons 44 are located within the fly pockets 19. In such an embodiment, the flywings 16 have slots to allow the pistons 44 to move from the first position to the second position while remaining within the fly pockets 19.

The foregoing detailed description has been given for clarity of understanding only and no unnecessary limitations should be understood therefrom as modifications will be obvious to those skilled in the art.

What is claimed is:

1. A fly stripping apparatus for a rotating fly assembly having a plurality of fly pockets for receiving sheet-like material from one location and delivering the sheet-like material to a second location, each pocket having a rear portion and a forward portion, the fly stripping apparatus comprising:

a movable member disposed adjacent the rear portion of each fly pocket during a first portion of the rotation of the fly assembly;

wherein, during a second portion of the rotation of the fly assembly, a part of each member moves from a position adjacent the rear portion of its respective fly pocket toward the forward portion of the respective fly pocket to eject the sheet-like material from the fly pocket.

2. The fly stripping apparatus of claim 1 and comprising a cam for moving the part of each member from the position adjacent the rear portion of its respective fly pocket toward the forward portion of the respective fly pocket.

3. The fly stripping apparatus of claim 2 and comprising a cam follower attached to the movable member.

4. A fly stripping apparatus for a rotating fly assembly having a plurality of fly pockets for receiving printed material and delivering the printed material to a desired location, wherein each of the fly pockets has a rear portion and a forward portion, the fly stripping apparatus comprising:

a cam positioned adjacent the fly assembly;

a plurality of levers having a first end portion and a second end portion, wherein the first end portion of each lever is located adjacent a respective fly pocket and the second end portion of each lever is pivotally attached to the fly assembly; and a cam follower attached to each lever for following the cam during rotation of the fly assembly;

wherein, during rotation of the fly assembly, the first end portion of each lever moves from a first position to a second position;

the first position being a position adjacent the rear portion of a respective fly pocket to permit the fly pocket to receive the printed material;

the second position being a position between the first position and the forward portion of the respective fly pocket to eject the printed material from the fly pocket.

5. The fly stripping apparatus of claim 4 and comprising:

a plurality of springs each having a first end attached to one of the levers for returning the respective lever to the first position from the second position.

6. The fly stripping apparatus of claim 5 wherein a second end of each spring is attached to the fly assembly.

7. The fly stripping apparatus of claim 4 wherein the cam is stationary with respect to the fly assembly.

8. The fly stripping apparatus of claim 4 wherein the cam has an arcuate portion, each lever moving from the first position to the second position while its respective follower follows the arcuate portion of the cam.

9. The fly stripping apparatus of claim 8 wherein the cam has a return portion which slopes inwardly, each lever moving from the second position to the first position while its respective follower follows the return portion of the cam.

10. The fly stripping apparatus of claim 4 wherein the first end portion includes a piston for ejecting the printed material from the fly pocket.

11. A method of stripping printed material from fly pockets of a rotating fly assembly, the fly assembly having a plurality of pockets for receiving printed material from one location and delivering the printed material to a second location, each pocket having a rear portion and a forward portion, the method comprising the steps of:

providing an ejector having an operative portion adjacent each pocket;

moving the operative portion of the ejector via a cam positioned adjacent the fly assembly, during rotation of the fly assembly, from a position adjacent the rear portion of its respective fly pocket toward the forward portion of the respective fly pocket; and thereby causing the ejector to eject the printed material from the fly pocket.

12. The method of claim 11 further including the steps of:

providing the cam in a stationary position adjacent the fly assembly;

providing a cam follower on each ejector; and rotating the cam followers around the stationary cam to move the operative portion of the ejectors relative to the respective fly pockets.

* * * * *

UNITED STATES PATENT AND TRADEMARK OFFICE

CERTIFICATE OF CORRECTION

PATENT NO. : 6,131,904

DATED : October 17, 2000

INVENTOR(S) : Tomczak

It is certified that error appears in the above-identified patent and that said Letters Patent is hereby corrected as shown below:

Column 3, line 45, please delete "bottom most" and insert in its place --bottommost--.

Signed and Sealed this

Eighth Day of May, 2001

*Attest:*

Nicholas P. Godici

NICHOLAS P. GODICI

*Attesting Officer*

*Acting Director of the United States Patent and Trademark Office*